US010647456B2

(12) United States Patent
Reckin et al.

(10) Patent No.: US 10,647,456 B2
(45) Date of Patent: May 12, 2020

(54) PACKAGING

(71) Applicant: TECHNOPAK LIMITED, Auckland (NZ)

(72) Inventors: Shane Robert Reckin, Auckland (NZ); Denys Anthony Hendra, Auckland (NZ); Scott Edward Leaning, Auckland (NZ)

(73) Assignee: TECHNOPAK LIMITED, Auckland (NZ)

( * ) Notice: Subject to any disclaimer, the term of this patent is extended or adjusted under 35 U.S.C. 154(b) by 249 days.

(21) Appl. No.: 15/705,758

(22) Filed: Sep. 15, 2017

(65) Prior Publication Data

US 2018/0002043 A1 Jan. 4, 2018

Related U.S. Application Data

(63) Continuation of application No. 13/817,992, filed as application No. PCT/NZ2011/000159 on Aug. 17, 2011, now abandoned.

(30) Foreign Application Priority Data

Aug. 20, 2010 (NZ) ..... 587481

(51) Int. Cl.

| | |
|---|---|
| ***B65D 33/34*** | (2006.01) |
| ***B65B 61/20*** | (2006.01) |
| ***B65B 7/02*** | (2006.01) |
| ***B65B 51/14*** | (2006.01) |

(52) U.S. Cl.

CPC ..... *B65B 7/02* (2013.01); *B65B 51/146* (2013.01); *B65D 33/34* (2013.01)

(58) Field of Classification Search

CPC ..... B65B 61/20; B65D 33/2516; B65D 33/34
USPC ..... 53/463
See application file for complete search history.

(56) References Cited

U.S. PATENT DOCUMENTS

| | | | |
|---|---|---|---|
| 3,879,917 | A | 4/1975 | Bassendale |
| 4,464,158 | A | 8/1984 | Kardon |
| 4,509,196 | A | 4/1985 | Sak et al. |
| 4,721,217 | A | 1/1988 | Phillips et al. |
| 4,749,084 | A | 6/1988 | Pereyra |
| 4,758,296 | A | 7/1988 | McGrew |

(Continued)

FOREIGN PATENT DOCUMENTS

| | | |
|---|---|---|
| DE | 4017759 | 12/1991 |
| EP | 1669051 | 6/2006 |

(Continued)

OTHER PUBLICATIONS

International Search Report, PCT/NZ2011/000159, dated Jan. 10, 2012.

*Primary Examiner* — Gloria R Weeks
(74) *Attorney, Agent, or Firm* — Young & Thompson

(57) ABSTRACT

A method of packaging a product within a bag includes the step of providing for at least one product security element to be present on or within the bag, in a region of where the bag will be sealed. The method also includes the steps of filling the bag with the product, and subsequently sealing the bag, using heat sealing apparatus, whereby the seal thus formed passes through at least a portion of the at least one product security element, thereby permanently heat sealing the product security element to the bag.

19 Claims, 4 Drawing Sheets

(56) References Cited

U.S. PATENT DOCUMENTS

| | | | | |
|---|---|---|---|---|
| 4,787,194 | A | 11/1988 | Lancaster | |
| 5,005,719 | A | 4/1991 | Phillips | |
| 5,412,924 | A | 5/1995 | Ausnit | |
| 5,492,411 | A | 2/1996 | May | |
| 5,727,684 | A | 3/1998 | Webb et al. | |
| 5,823,933 | A | 10/1998 | Yeager | |
| 5,851,615 | A | 12/1998 | Kay | |
| 5,913,543 | A | 6/1999 | Curiel | |
| 5,924,795 | A | 7/1999 | Thompson | |
| 6,009,925 | A | 1/2000 | Hall | |
| 6,246,033 | B1 | 6/2001 | Shah | |
| 6,264,033 | B1 | 7/2001 | Kannabiran | |
| 6,312,742 | B1 | 11/2001 | Wood et al. | |
| 6,346,321 | B1 | 2/2002 | Stober | |
| 6,477,820 | B1 | 11/2002 | Dutra | |
| 6,962,439 | B2 | 11/2005 | Taheri | |
| 6,975,765 | B2 | 12/2005 | McGrew et al. | |
| 7,008,106 | B2 | 3/2006 | Cappel | |
| 7,095,324 | B2 | 8/2006 | Conwell et al. | |
| 7,223,015 | B2 | 5/2007 | Steffens | |
| 7,406,811 | B2 * | 8/2008 | Fresnel | B65D 23/14 53/415 |
| 7,543,708 | B2 | 6/2009 | Doyle et al. | |
| 7,544,266 | B2 | 6/2009 | Herring | |
| 8,284,468 | B2 * | 10/2012 | Saito | G03H 1/0011 359/2 |
| 8,366,855 | B2 * | 2/2013 | Murray | B65B 3/04 156/249 |
| 2002/0043051 | A1 | 4/2002 | Manica | |
| 2003/0168162 | A1 | 9/2003 | Eile | |
| 2007/0123836 | A1 | 5/2007 | Fukushima et al. | |
| 2008/0050055 | A1 * | 2/2008 | Austreng | B65D 33/1691 383/210 |
| 2009/0114561 | A1 * | 5/2009 | Kothmeier | B65B 9/045 206/534 |
| 2009/0226117 | A1 | 9/2009 | Davis | |
| 2009/0255626 | A1 * | 10/2009 | Murray | B65B 61/186 156/253 |
| 2011/0268371 | A1 | 11/2011 | Kristal | |
| 2013/0212984 | A1 * | 8/2013 | Reckin | B65B 7/02 53/469 |
| 2017/0305628 | A1 * | 10/2017 | Chaturvedi | B65D 75/5838 |

FOREIGN PATENT DOCUMENTS

| | | |
|---|---|---|
| EP | 1860038 | 11/2007 |
| GB | 2138396 | 10/1984 |
| GB | 2 238 292 | 5/1991 |
| GB | 2259496 | 3/1993 |
| GB | 2327933 | 2/1999 |
| GB | 2403207 | 12/2004 |
| JP | 06-072464 | 3/1994 |
| NZ | 531014 | 6/2006 |
| WO | WO 93/08084 | 4/1993 |
| WO | WO 2000/046122 | 8/2000 |
| WO | WO 2006/019324 | 2/2006 |
| WO | WO 2009/141925 | 11/2009 |

* cited by examiner

PACKAGING

FIELD OF THE INVENTION

This invention relates to packaging. More specifically, the invention relates to packaging which incorporates tamper evident means (for ensuring the packaging has not been tampered with) and/or product security means (for verifying the authenticity of the packaged product).

The invention may be particularly suitable for use with plastic films or plastic bags used in the packaging industry—and especially so in relation to products intended for human consumption. However, it is to be understood and appreciated that the invention may also have other applications and uses. For example, the invention may also be used in relation to plastic packaging for forensic evidence or electronic equipment, and/or for plastic packaging containing important documents or money. The prior art and possible applications of the invention, as discussed below, are therefore given by way of example only.

BACKGROUND OF THE INVENTION

Ensuring that a product has not been tampered with after being packaged can be of considerable importance, and especially so for products intended for human consumption, such as food, drink and pharmaceutical products.

It is therefore advantageous to be able to provide packaged products with tamper evident means.

An example of where this may be of particular importance is the bulk packaging of food products, which often undergo further processing by the recipient of the product.

For example, powdered or particulate food products such as flour and milk powder are usually bulk-packaged within large 25 kg bags. The recipient of such bulk packaged products will want to ensure that each package has not been tampered with prior to its arrival and/or prior to the further processing of the product. The further processing may, for example, include blending the bulk packaged product in with other ingredients and/or subsequently repackaging the product into smaller packages. If subsequent tests showed that the blended product and/or repackaged product contained impurities, but that the bulk packaged product arrived with no evidence of it having been tampered with, then the bulk packaged product may be disregarded as the possible source of the contamination. This would not only serve to exonerate the product manufacturer, but it would be useful in helping to narrow down the possible source of the contamination.

It would therefore be advantageous if there was available a means of providing bulk packaged food products with tamper evident means.

An example of a tamper evident means for use with the packaging of products is described in NZ Patent No. 531014. This patent describes a system for vacuum packaging a product within bags, for example general food products or milk powders. The system described is effective in showing if the contents of any one bag have been tampered with, because the tampered bag would lose its vacuum, and this would therefore be apparent to the person or company receiving or using the bag.

However, the technology described in NZ Patent No. 531014 (whilst usually effective) is somewhat complex, and the machinery required to produce the vacuums is reasonably large, and expensive. This may be prohibitive to some companies wishing to use the technology. Furthermore, the procedure of forming a vacuum in each and every bag may take a reasonable amount of time, and this may therefore reduce the speed or operating capacity of the packaging line.

It would be advantageous therefore if there was available an alternative tamper evident means for use with the packaging of products.

There are many examples in the prior art of tamper evident means for use with the packaging of valuable or important items such as money, documents or forensic evidence. Examples of such tamper evident technologies include: the use of points of weakness in the packaging material; microdot markers; UV fluorescent dies; tamper evident adhesives—and combinations of these technologies. Examples may be found in the following patent documents: U.S. Pat. Nos. 7,095,324, 4,509,196, 7,008,106, 4,464,158, 6,962,439 and DE4017759A1.

However, whilst these tamper evident technologies may be effective to some degree, they do not also offer a product security means for validating the authenticity of the packaged product.

As a result, product security technologies for use with packaging have emerged, most notably devices such as holograms or Optically Variable Devices (OVD). OVD's are usually attached to packaging materials by the use of adhesives, for example by hot foil stamping or by the use of pre-applied adhesives stuck to a carrier film.

Examples of the use (or manufacture) of OVD's for packaging may be found in the following patent documents: U.S. Pat. Nos. 5,913,543, 6,975,765, 7,095,324 and 4,758,296.

However, a disadvantage associated with the use of OVD's is that they may be susceptible to being removed from the packaging material, for example by the use of solvents to weaken the adhesives. In such instances, they may then be reapplied to a counterfeit or tampered product.

Alternatively, OVD's may be cut from the packaging material and removed, before being reapplied to a counterfeit or tampered product.

Another disadvantage associated with the use of OVD's is that they do not usually provide, or offer, tamper evident means. That is, the presence of an OVD may indicate that the packaged product is genuine, however the OVD may not be able to also indicate whether or not the packaged product (or the OVD itself) has been tampered with. Hence, if a packaged product (or OVD) has been tampered with, without destroying the integrity of the packaging (or the OVD), then the end user may be none the wiser.

It would be of advantage therefore if there was available packaging which included a product security means which may also serve as a tamper evident means.

It is an object of the present invention to provide packaging methods and apparatus which go some way towards addressing the aforementioned problems or difficulties, or which at the very least provides the public with a useful choice.

DEFINITIONS

Throughout this specification unless the text requires otherwise, the word "comprise" and variations such as "comprising" or "comprises" will be understood to imply the inclusion of a stated integer or step or group of integers or steps but not the exclusion of any other integer or step or group of integers or steps.

The term "product security means" as used throughout this specification is defined as meaning any suitable means for verifying or confirming the authenticity of a packaged product. Examples of product security means include (but are not limited to) hologram devices and/or OVD's (see definition below).

The term OVD, as used throughout this specification, is defined as meaning an "Optically Variable Device". This term will be well known to those skilled in the art, and includes (but is not limited to) holograms such as laser generated holographic images and electron beam images. Frequently used OVD technologies include (but are not limited to): 2D/3D laser generated images; dot matrixes; filmed stereograms; combination images; and Ebeam images.

SUMMARY OF THE INVENTION

According to one aspect of the present invention, there is provided a method of packaging a product within a bag, said method including the steps of:

a) providing for at least one product security means to be present on or within the bag, in a region of where the bag will be sealed,
b) filling the bag with the product,
c) subsequently sealing the bag using heat sealing apparatus, whereby the seal thus formed passes through at least a portion of the at least one product security means, thereby permanently heat sealing the product security means to the bag.

According to another aspect of the present invention there is provided a method of packaging a product within a bag, substantially as described above, wherein the product security means is applied to the inside of the bag.

According to another aspect of the present invention there is provided a method of packaging a product within a bag, substantially as described above, wherein the product security means is applied to the outside of the bag.

According to another aspect of the present invention there is provided a method of packaging a product within a bag, substantially as described above, wherein step b) is carried out before step a).

According to another aspect of the present invention there is provided a method of packaging a product within a bag, substantially as described above, wherein the bag is a plastic bag.

The bag may be any type of bag, and of any size or shape, as required or as desired—or as dictated by the type of product(s) to be packaged therein.

Preferably, the bag may be a plastic bag, for example a bag made from a plastic material(s) or film(s).

In one embodiment, the bag may be comprised of a single laminate of plastic material, for example a single sheet of polyethylene.

Alternatively, the bag may be comprised of two or more laminates of plastic material(s), such as with co-extruded film. In such an embodiment the bag may include different types of plastic material, for example it may include a laminate of a gas impermeable film and/or a laminate which is printed, translucent or opaque.

The bag may also include one or more substrates.

For example, the bag may include a thin aluminium foil—such as found inside potato chip or crisp packets.

Alternatively, or additionally, the bag may include one or more outer layers of paper—such as bags used for the bulk packaging of food products such as milk powders.

One purpose of the product security means may be to verify the authenticity of the packaged product.

Preferably, the product security means may include at least one OVD.

The bag may also include an RFID tag to enable the tracking of the bag. The use of such RFID tags are well known in the prior art, and by those skilled in the art.

The bag may also include a unique identifier. The type of information which may be included in or on a unique identifier may include (but not be limited to): where the bag was packed; what the product is inside the bag; the date and/or time the bag was packed; the Batch Number; the date of dispatch from the factory; the destination of the bag, and so on. Examples of suitable unique identifiers include visible components such as printing or barcodes, or non-visual components such as nano-image screening or components that may only be visible under a certain light, for example an ultra-violet light.

The method of packaging may preferably include the step of providing for at least one product security means to be present on or within the bag, in a region of where the bag will be sealed.

In one embodiment, the product security means may be applied to the inside of the bag. One advantage of doing so is that the product security means is unable to be accessed or tampered with (after the bag has been sealed) without destroying the integrity of the bag.

In an alternative embodiment, the product security means may be applied to the outside of the bag.

In one embodiment, the product security means may be applied by a process known as hot stamping. This process generally involves the use of an OVD with a pre-applied, heat activated adhesive. The OVD may therefore be applied to the inside or outside of the bag using heat and compression. During this process the OVD is compressed against the bag with a heated die whereby the adhesive is reactivated and bonds the OVD to the bag.

Alternatively, the product security means, such as an OVD, may be applied to the inside or outside of the bag by a pre-applied adhesive which is stuck to a carrier film. In such an embodiment, a suitable applicator would apply the OVD to the inside or outside of the bag and supply compression.

In a further embodiment, the product security means, such as an OVD, may have adhesive applied just prior to application of the OVD to the inside or outside of the bag. Compression may then be applied to adhere the OVD to the inside or outside of the bag. In the case of a UV adhesive, the bag may be passed through a UV curing light.

The application of the product security means to the inside or outside of the bag may occur at the place where the product is being packaged. Alternatively the application of the product security means may take place at the place where the bags are manufactured.

Preferably, the product security means may be applied to the inside or outside of the bag just prior to the bag being filled.

In an alternative embodiment, the bag may be filled prior to the product security means being applied (this embodiment may be more appropriate if the product security means is to be applied to the outside of the bag, as it may be difficult to apply the product security means to the inside of the bag once the bag has been filled).

According to another aspect of the present invention there is provided a method of packaging a product within a bag, substantially as described above, wherein the bag is a plastic bag including two or more laminates of plastic material, and the product security means is incorporated within the laminates of the plastic material.

In such an embodiment, the product security means may be incorporated within the laminates of the plastic bag (or the films which are to form the plastic bag) during the formation of the plastic material which will subsequently be converted into a plastic bag.

For example, many plastic bags are made by extruding two or laminates of plastic material from a molten polymer(s) through a die or dies—the most common processes being known as the blown film process and the cast film process (these processes will be well known to those skilled in the art). The product security means may therefore be introduced between the laminates of plastic materials as they are being formed. Hence, when the laminates of plastic are subsequently cooled to thus form the plastic material which will subsequently form the bag, the product security means will be incorporated within the laminates of the plastic.

An alternative method of forming a plastic bag which includes two or more laminates of plastic material may be by joining together two or more plastic films, for example by gluing or by the application of a RF heat sealer. In such an embodiment, the product security means may be introduced between the laminates of plastic material prior to them being joined together. Hence, the product security means may be incorporated within the laminates of the plastic material which is subsequently converted into the plastic bag.

In yet another embodiment, the product security means may be printed onto the laminates of plastic material which subsequently form the plastic bag. This is relatively new technology, however an example of how this may be achieved may be found in US Patent Application Publication No. US 2005/0279236.

One advantage of having the product security means incorporated within the laminates of the plastic bag is that the product security means is unable to be accessed or tampered with (both before and after the bag has been sealed) without destroying the integrity of the bag.

Once the bag has been filled, the bag may then be sealed using heat sealing apparatus. Such heat sealing apparatus for sealing bags will be well known to those skilled in the art, and it is not intended therefore to describe the process in any great detail herein. Examples of suitable heat sealing apparatus are those manufactured by our company, Technopak Limited of Auckland, New Zealand.

Preferably, the heat sealing apparatus may include heated bars which come together under pressure to form the seal, and thus seal the bag.

Alternatively, the heat sealing apparatus may be in the form of a RF heat sealer (or RF welder—as such machines are sometimes called).

In one embodiment, the seal created by the heat sealing apparatus may pass through at least a portion of the at least one product security means—which serves to permanently heat seal (or heat-weld) the product security means to, or within, the bag. In essence, this means that the product security means may be considered to have become part of the bag.

In the embodiments where the product security means is adhered to the inside or the outside of the bag, this serves to provide an additional level of adherence of the product security means to the bag—over and above the adherence provided by the adhesive used for applying the product security means to the bag.

According to another aspect of the present invention there is provided a method of packaging a product within a bag, substantially as described above, wherein the seal thus formed passes through the whole of the at least one product security means By heat sealing through the whole of the at least one product security means, it may be appreciated that the product security means that is applied to the outside of the bag (in particular) is even less likely to be susceptible to being removed as the entire product security means is encapsulated within the heat seal and/or heat-welded to the bag. Hence the seal of the bag is not able to be compromised or broken without also destroying the integrity of the product security means.

One advantage of heat sealing the product security means to or within the bag in this fashion is that it means that the product security means is not able to be removed from the bag without its removal being apparent. For example, a product security means which was applied to the outside of the bag could not be removed by the use of adhesive-removing solvents (which may otherwise affect the integrity of adhesives commonly used for securing product security means to bags). This is because the solvents would not have the ability to break the heat seal or heat-weld between the product security means and the bag.

Another advantage of the invention is that if the product security means were cut from, or out of, the bag, it could not be reused in an unauthorized fashion (for example, by applying it to a bag containing counterfeit or tampered product). This is because the heat-weld passing through the product security means would leave a physical impression in the product security means, which would be noticeable. Furthermore, it would be difficult to re-adhere a removed product security means to another bag because the adhesive must be applied, in whole or in part, to the bag material (which would still be welded to at least part of the product security means).

Hence, the invention may be an improvement over existing tamper evident means and product security means. This is because the product security means not only provides validation of the authenticity of the product, but because it is permanently heat sealed to or within the bag, it also provides a tamper evident means for both itself and the packaged product as a whole. Moreover, by heat sealing the product security means to or within the bag, there is no need to also provide the packaged product with a separate tamper evident means, as is often the case. This has savings in cost as well as packaging speed and efficiency.

In another embodiment of the invention, the product security means may be applied to the inside or outside of the bag during the formation of the bag, for example during the conversion of plastic film to plastic bags.

It is also envisaged that more than one product security means may be provided for any one bag. For example, the product security means may be provided at appropriate places and/or intervals, whereby when plastic film is converted into plastic bags, the seals used to seal the sides and/or the bottoms of the plastic bags may pass through some or all of the product security means.

Hence, each resultant bag to be used for packaging may have a number of product security means associated with it, for example, along the bottom seal of the bag and/or one or both of the side seals of the bag.

It may be appreciated that having more than one product security means heat sealed to the bag, renders it even more difficult for the bag to be tampered with and/or for the authenticity of the product packaged within the bag to be compromised.

BRIEF DESCRIPTION OF THE DRAWINGS

The description of a preferred form of the invention to be provided herein, with reference to the accompanying drawing, is given purely by way of example and is not to be taken in any way as limiting the scope or extent of the invention.

DETAILED DESCRIPTION OF THE INVENTION

Figure 1:
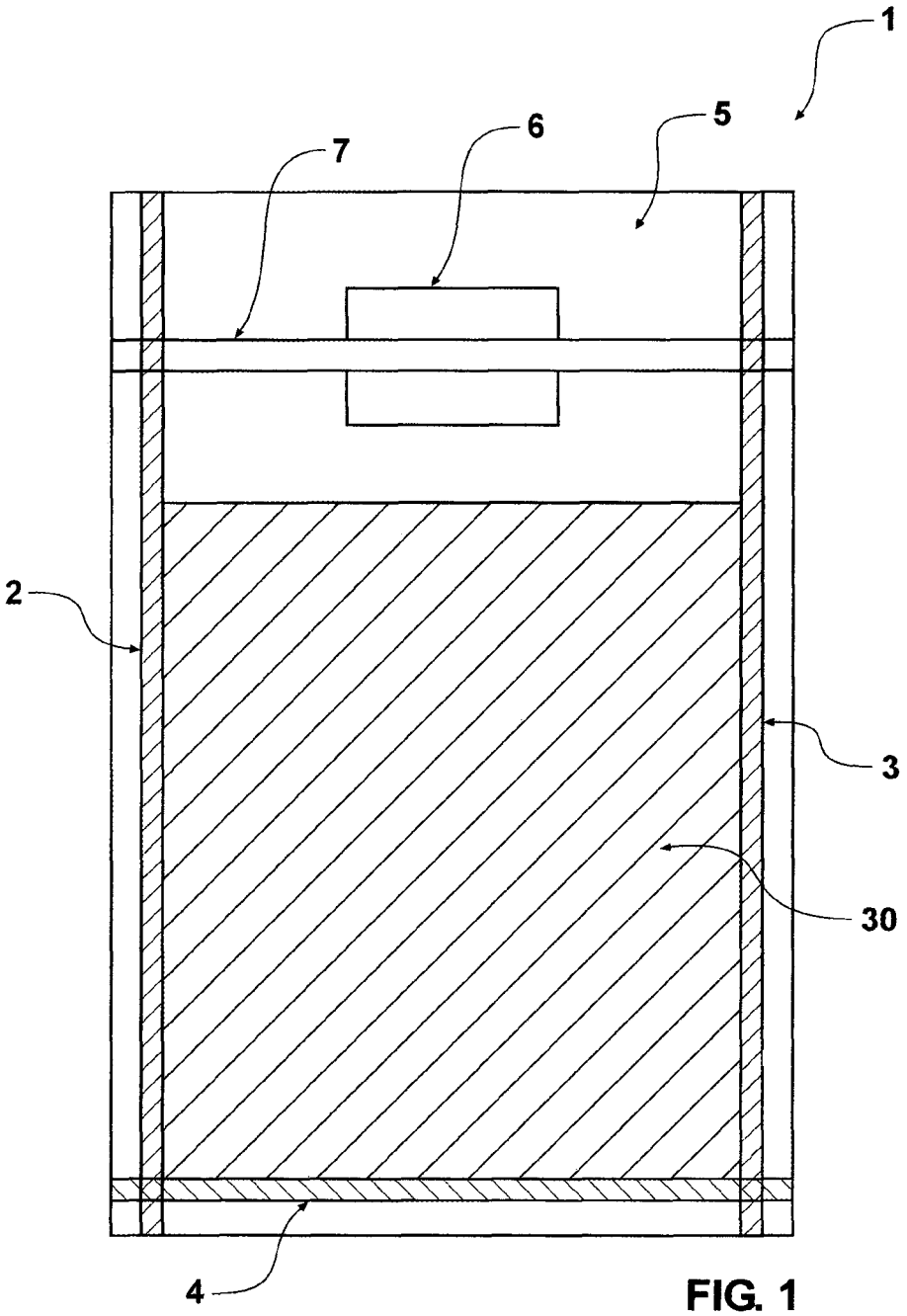
FIG. 1: is a view of a bag packaged according to one possible embodiment of the method of the present invention.

Having regard to FIG. 1, there is shown a bag packaged according to one possible embodiment of the present invention.

The bag 1 is the inner plastic bag used for the bulk packaging of milk powder 30, and it is designed to hold 25 kg of milk powder 30.

The inner plastic bag 1 would usually sit within an outer paper bag comprising one or more plies of a paper material—but for convenience of illustration only, the outer paper layers are not shown. In use, the inner plastic bag 1 is designed to be filled with milk powder 30 and the outer paper bag is designed to provide a covering for the inner plastic bag 1 during storage and/or transportation etc.

Such bags used for the bulk packaging of milk powder are well known within the dairy industry, and several examples may be referenced in NZ Patent Nos. 183617 and 242034.

It is also envisaged however that the bag 1 may be utilized on its own, that is, without being housed within a paper outer bag.

Generally speaking, most inner plastic inner bags 1 of the type illustrated are made up from anywhere between 1-12+ laminates of an extruded plastics material(s), for example polyethylene. As a general rule of thumb, the plastic bag 1 should include at least 5 layers of extruded plastics materials in order to provide the bag 1 with the required carrying strength and/or to render the bag substantially or wholly gas impermeable.

Alternatively or additionally, the bag 1 may include one or more specific plastic(s) layers designed to render the bag 1 gas impermeable. An example of such a plastics material would be an EVOH polymer.

The film comprising the bag 1 is formed from a blown film extrusion process. Such a process will be well known by those skilled in the art and it is not intended therefore to describe this process in any great detail herein.

The film formed by the blown film extrusion process is subsequently converted into the bag 1 by known conversion processes. Examples of suitable conversion machinery for the purposes of bag making are those manufactured by Windmoeller and Hoelscher of Germany (especially for the dairy industry) and Totani Corporation of Japan.

The bag 1 is thus formed by heat sealing the plastic film along two sides to produce the side seals 2, 3 and also heat sealing along the bottom to produce the bottom seal 4. The top of the bag 5 is left open and the formed bags may then be shipped to the end user—in this case to the dairy factory which will be packaging the milk powder 30.

A product security means is applied to the outside of the upper part of the bag 1 prior to the bag 1 being filled with milk powder 30. In the embodiment shown the product security means is an OVD indicated by arrow 6. The OVD is attached to the bag 1 by the use of known hot stamping methods, and it is applied to the bag 1 in the region of where the bag 1 will be subsequently sealed.

The OVD 6 is of a type manufactured and marketed by Leonhard Kurz GmbH & Co KG, of Germany, under its brand name TRUSTSEAL®.

Examples of other types of product security means and/or OVD's that may be used with the present invention include those which Leonhard Kurz GmbH & Co KG describe under the following headings in its promotional literature:

1 Diffractive Black
2 CONTRUST®
3 Lens Variation
4 Advanced Hidden Feature
5 Nano Image Screen
6 Optically Variable Devices
7 TRUSTCODE®
8 HOLONETICS®

Such product security means are advantageous because they are extremely difficult, if not impossible, to successfully imitate or reproduce.

After the OVD 6 has been applied to the bag 1, the bag 1 may then proceed to a filling station where the bag 1 may be filled with milk powder 30.

Once the bag 1 has been filled, it may then be sealed using heat sealing apparatus (not shown). The heat sealing apparatus may preferably be in the form of two heated bars which come together under pressure on both sides of the bag 1 to thus seal the bag 1 and create the seal 7. Such heat sealing apparatus will be well known to those skilled in the art, and examples of suitable heat sealing apparatus are those manufactured by our company, Technopak Limited of Auckland, New Zealand.

In an alternative embodiment, it is envisaged that the bag 1 could be filled prior to the OVD 6 being applied to the bag 1, however it may generally be easier to apply the OVD 6 to an empty bag 1 rather than to a bag 1 that has already been filled with milk powder 30.

The seal 7 passes through a portion of the OVD 6, which serves to essentially permanently heat-seal or weld the OVD 6 to the bag 1, whereby the OVD 6 (or at least the portion of the OVD 6 which has the seal 7 passing through it) may be considered to have become part of the bag 1.

This serves to provide an additional level of adherence of the OVD 6 to the bag 1—over and above the adherence provided by the adhesive used for applying the OVD 6 to the bag 1.

One advantage of permanently heat sealing (or heat welding) the OVD 6 to the bag 1 in this fashion is that it means that the OVD 6 is not able to be removed from the bag 1, for example by the use of adhesive-removing solvents. This is because the solvents would not have the ability to break the heat-seal between the OVD 6 and the bag 1.

Furthermore, if the OVD 6 were cut from the bag 1, the OVD 6 could not easily be reused in an unauthorized fashion (for example, by applying the OVD to a bag containing counterfeit or tampered product). This is because the heat-seal 7 which passes through the OVD 6 leaves a physical impression in the OVD 6, which would be noticeable if the OVD 6 were reused. Furthermore, it would be difficult to re-adhere the removed OVD 6 to another bag because the adhesive must be applied, in part, to the plastic film (which would still be welded to the back of the OVD 6 if it was cut out).

Hence, the invention is an improvement over existing tamper evident means and product security means, because the OVD 6 not only provides validation of the authenticity of the packaged milk powder 30, but because the OVD 6 is permanently heat sealed to the bag 1, it also provides a tamper evident means for both itself and the packaged product as a whole. Moreover, by heat sealing the OVD 6 to the bag 1, there is no need to provide a separate tamper evident means, as is often the case. This has savings in cost as well as packaging speed and efficiency.

Figure 3:
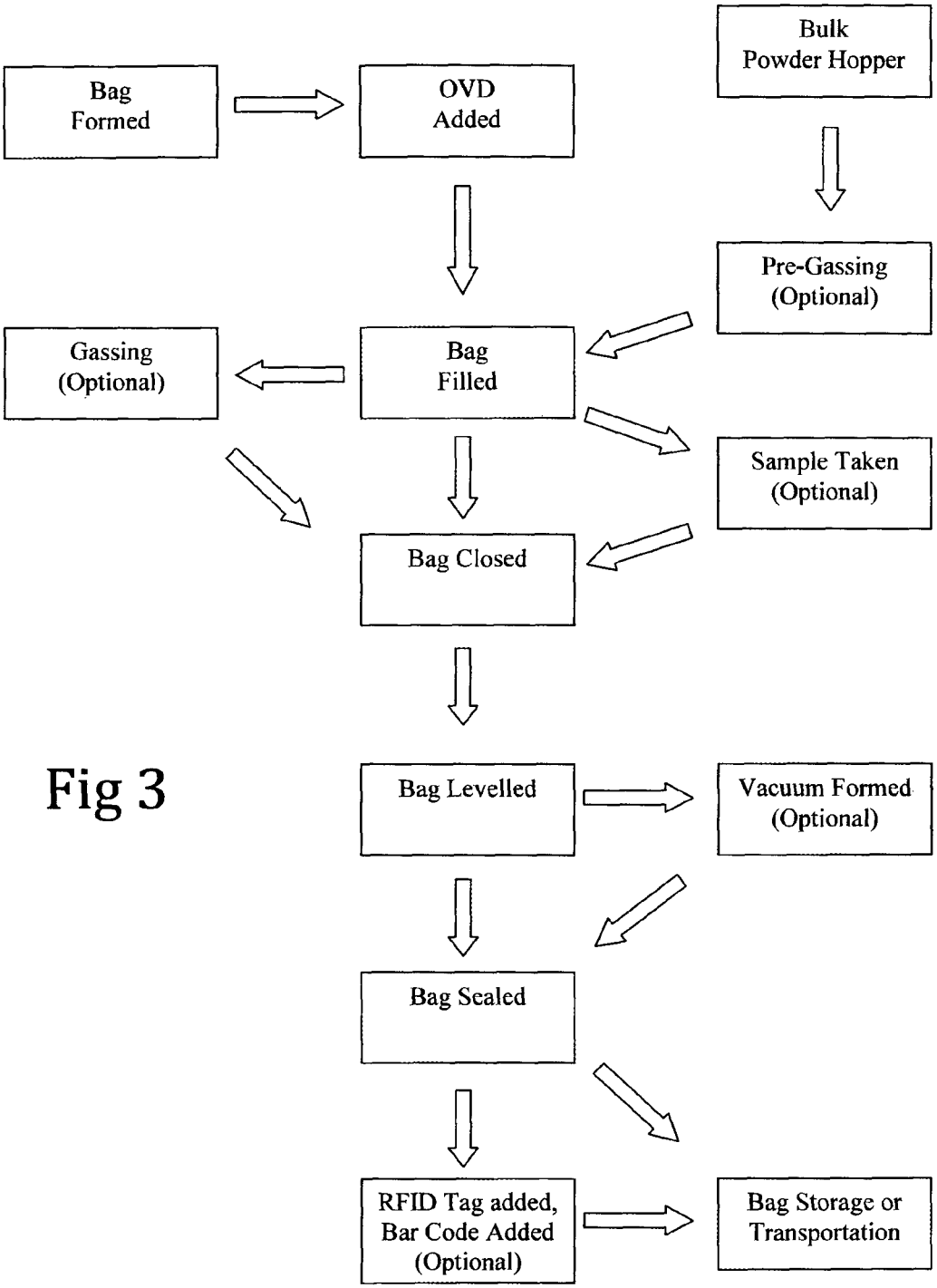
FIG. 3: is a flow chart illustrating the steps involved in the bulk packaging of milk powder, utilizing either of the bags illustrated in FIG. 1 or FIG. 2, and FIG. 4: is a view of a bag packaged according to another possible embodiment of the present invention.

FIG. 3 is a schematic diagram illustrating how the methodology of the present invention may be incorporated within a packaging line for the packaging of 25 kg bags of milk powder 30. The optional vacuum forming step may utilize the vacuum forming technology described in NZ Patent No. 531014. An example of a packaging line or packaging machinery that utilizes the various steps illustrated in FIG. 3 is that manufactured by Technopak Limited of Auckland, New Zealand.

Figure 2:
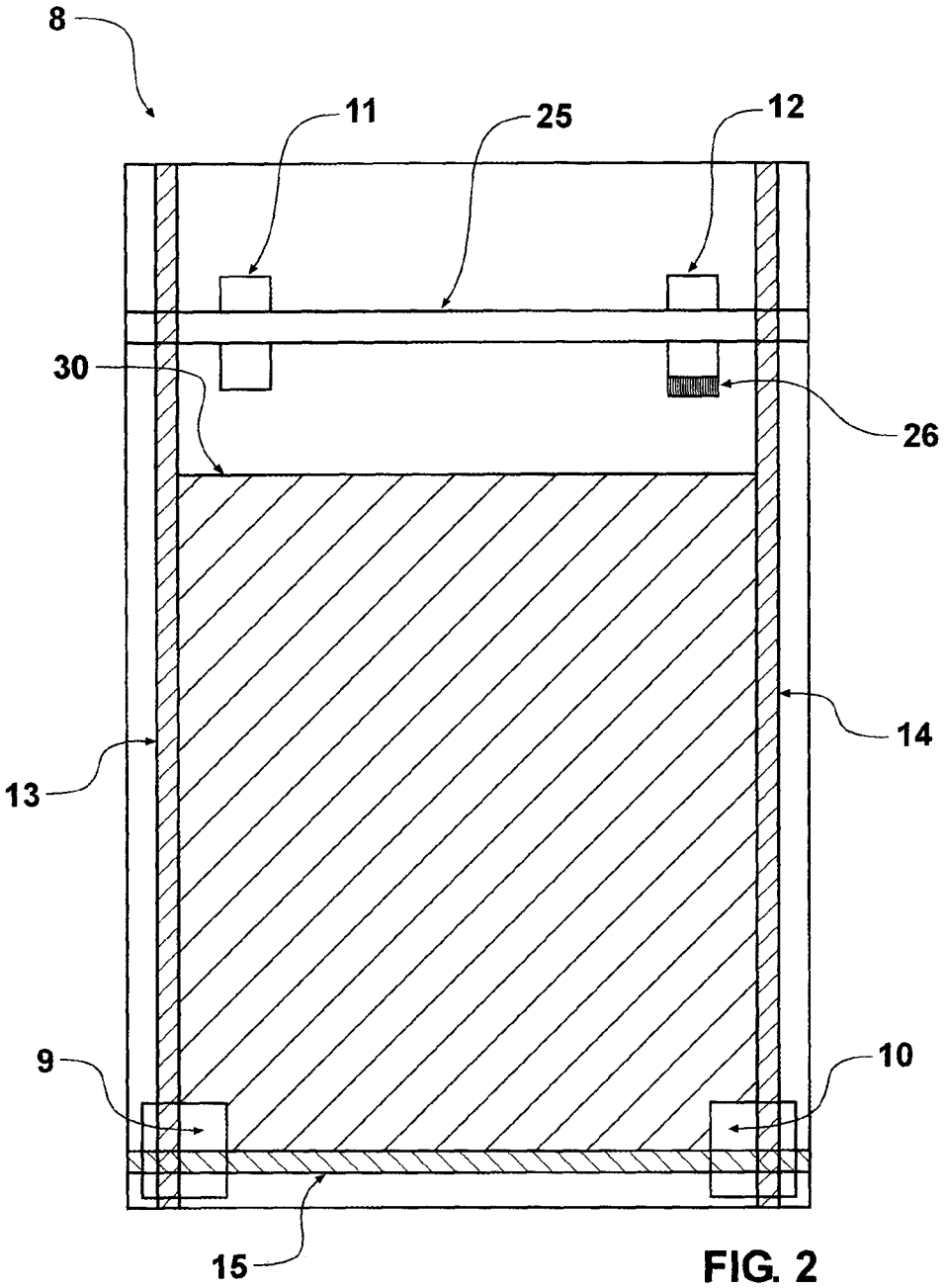
FIG. 2: is a view of a bag formed and packaged according to another possible embodiment of the method of the present invention.

FIG. 2 is a view of another plastic bag 8 which is also formed by blown film extrusion processes, and which is also designed for packaging 25 kg lots of milk powder 30. However, the bag 8 includes a greater number of OVD's, than the bag 1 illustrated in FIG. 1, and furthermore, there are also differences in when the OVD's are applied.

The bag 8 has four OVD's applied to it. There are two OVD's 9, 10 added to the bottom corners of the bag 8, and two OVD's 11, 12 added towards the top of the bag 8. The OVD's 11, 12 are situated in the region of where the bag 8 is to be subsequently sealed.

The lower OVD's 9, 10 are applied to the film comprising the bag 8 prior to the bag 8 being formed. Hence, the lower OVD's 9, 10 are subsequently heat sealed to the bag 8 when the side seals 13, 14 and bottom seal 15 are formed during the bag making (or conversion) process.

During the conversion process each bag 8 is formed by heat sealing the plastic film along two sides to produce the side seals 13, 14 and also heat sealing along the bottom to produce the bottom seal 15. It may be seen from FIG. 2 that the heat seals 13 and 15 both pass through the OVD 9 and that the heat seals 14 and 15 both pass through the OVD 10. Hence both OVD's 9, 10 are essentially heat sealed or heat welded to the bag 8—in substantially the same fashion (and with the same advantages) as the OVD 6 illustrated in FIG. 1.

The top of the bag 8 is left open and the formed bags 8 may then be shipped to the end user—in this case to the dairy factory which will be packaging the milk powder 30.

The bags 8 may then be filled with milk powder 30 and the bag 8 sealed using heat sealing apparatus (as previously referenced) to form the top seal 25. The top seal 25 passes through a portion of the OVD 11 and the OVD 12. Hence both OVD's 11, 12 are permanently heat sealed or heat welded to the bag 8—in substantially the same fashion (and with the same advantages) as the OVD 6 illustrated in FIG. 1.

The bag 8 also includes an RFID tag (not shown) and a unique identifier in the form of a barcode 26. The RFID tag and barcode 26 are applied to the bag 8 after the bag 8 has been sealed (see FIG. 3).

The OVD's 9, 10, 11 and 12 are of a type manufactured and marketed by Leonhard Kurz GmbH & Co KG, of Germany, under its brand name TRUSTSEAL®.

Having more than one OVD device secured to the bag 8 further enhances product security and also further protects the milk powder 30 from being tampered with.

Figure 4:
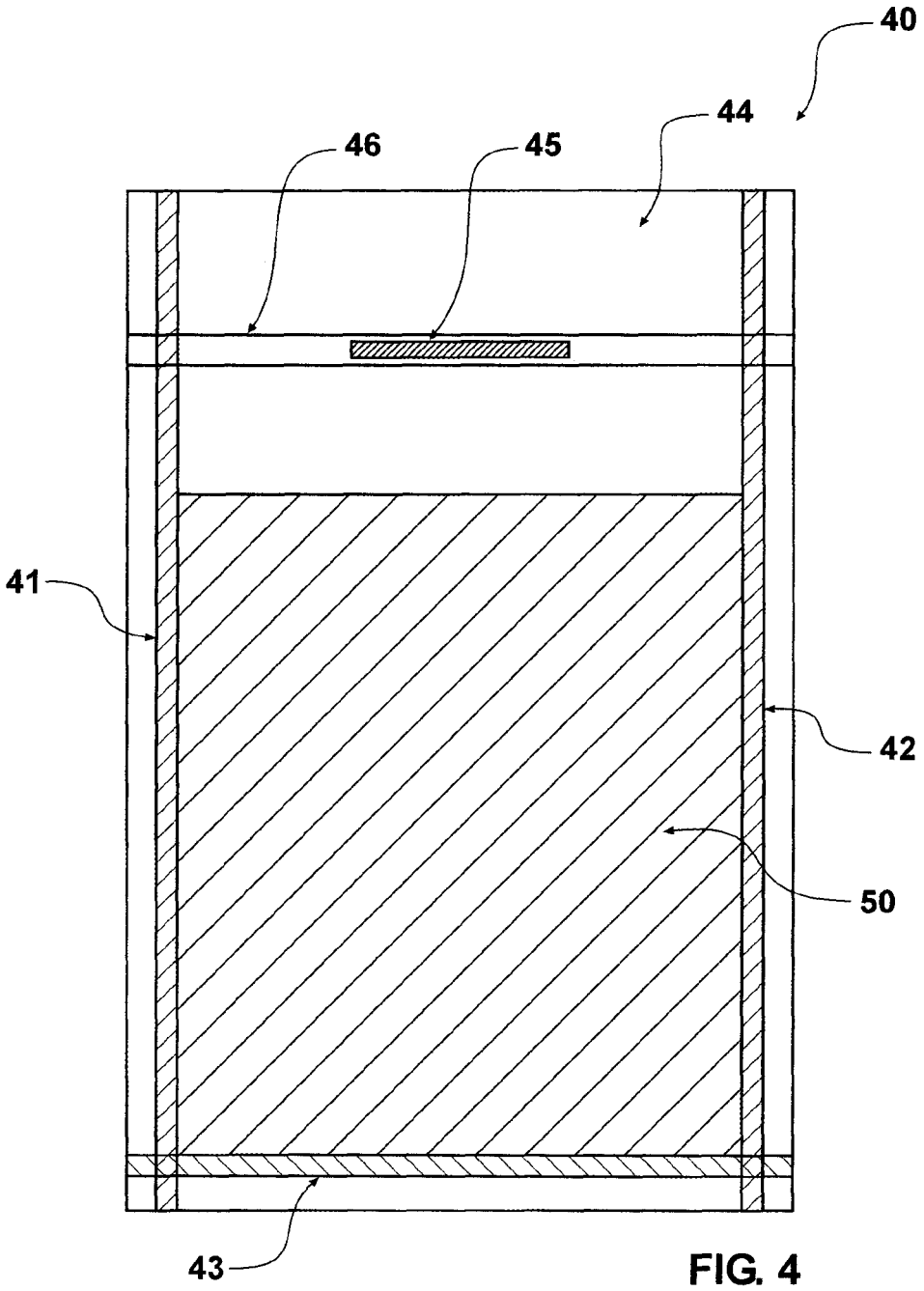

FIG. 4 illustrates a bag packaged according to another possible embodiment of the invention. The bag 40 is a plastic bag used for the secure packaging of pharmaceutical products 50.

The bag 40 is a plastic bag made up of laminates of plastic film formed by blown film extrusion processes. The bag 40 may preferably be comprised of between five to twelve laminates of plastic film.

Incorporated within the laminates of the plastic bag 40 is a product security means in the form of an OVD 45. The OVD 45 is of a type manufactured and marketed by Leonhard Kurz GmbH & Co KG, of Germany, under its brand name TRUSTSEAL®. The OVD 45 is incorporated within the laminates of plastic film when the laminates of plastic film are laminated together to form the plastic material which will subsequently be converted into the plastic bag 40.

As compared to the OVD 6 illustrated in FIG. 1 (which is substantially square and quite large in area), the OVD 45 is substantially elongate and much smaller in area.

The bag 40 is formed by heat sealing the laminated plastic material along two sides to produce the side seals 41, 42, and also heat sealing along the bottom to produce the bottom seal 43. The top of the bag 44 is left open and the formed bags 40 may then be shipped to the end user—where the product 50 may be packaged therein.

Once the bag 40 has been filled, it may then be sealed using heat sealing apparatus (as described previously). As can be seen from FIG. 4, the seal 46 passes through the whole of the OVD 45, (which serves to permanently heat-seal the OVD 45 to, or within, the bag 40). Or in other words, the entirety of the OVD 45 is encompassed within the area defined by the heat seal 46.

The OVD 45 is unable to be accessed or tampered with (after the bag 40 has been sealed) without destroying the integrity of the bag 40. This is due to the fact that the OVD 45 is encompassed within the laminates of the bag 40 and because the OVD 45 has essentially been heat-welded within the bag 40 during the heat sealing process.

It will be appreciated that the embodiment illustrated in FIG. 1 could alternatively be formed by having the OVD 6 applied to the inside of the bag 1 or by incorporating the OVD 6 within the laminates of the bag 1—prior to the sealing of the bag 1. Likewise, the embodiment illustrated in FIG. 4 could alternatively be formed by having the OVD 45 applied to the inside or the outside of the bag 40—prior to the sealing of the bag 40.

The invention is advantageous because it allows for a product security means to be permanently heat sealed or heat-welded to, or within, a bag. This provides the bag with both an effective tamper evident means (for ensuring the packaging has not been tampered with) and an impregnable product security means.

Whilst the invention has been predominantly described in relation to the packaging of food or pharmaceutical products, it is envisaged that the invention may also have other uses in the packaging industry. For example, the invention would also be effective when used in relation to plastic packaging for forensic evidence or electronic equipment, and/or for plastic packaging containing important documents or money.

While the embodiments described above are currently preferred, it will be appreciated that a wide range of other variations might also be made within the general spirit and scope of the invention and/or as defined by the appended claims.

The invention claimed is:

1. A method of packaging a product, the method comprising:

applying at least one product security element on or within a pre-formed bag, in a bag region to be sealed, the at least one product security element comprising an optically variable device (OVD);

filling the bag with the product; and subsequently forming a seal and sealing the pre-formed bag using a heat sealing apparatus, the seal passing through at least a portion of the at least one product security element to permanently heat seal the product security element to the bag.

2. The method according to claim 1, wherein the product security element is provided on the inside of the bag.

3. The method according to claim 1, wherein the product security element is provided on the outside of the bag.

4. The method according to claim 1, wherein the filling the bag with product is carried out before providing the at least one product security element to be present on or within the bag.

5. The method according to claim 1, wherein the bag is a plastic bag.

6. The method according to claim 5, wherein the plastic bag comprises two or more laminates of plastic material, and the at least one product security element is incorporated within the laminates of the plastic material.

7. The method according to claim 1, wherein the bag comprises one or more substrates.

8. The method according to claim 7, wherein the one or more substrates includes aluminum foil.

9. The method according to claim 7, wherein the one or more substrates includes paper.

10. The method according to claim 1, wherein the product is a food product or a pharmaceutical product.

11. The method according to claim 1, wherein the product is milk powder.

12. The method according to claim 1, wherein the bag is filled with 25 kg of the product.

13. The method according to claim 1, wherein the heat sealing apparatus includes heated bars which come together under pressure to form the seal, and thus seal the bag.

14. The method according to claim 1 wherein the heat sealing apparatus is a radio frequency (RF) heat sealer.

15. The method according to claim 1, wherein the bag is further provided with a radio frequency identifier (RFID) tag.

16. The method according to claim 1, wherein the bag is further provided with a barcode.

17. A bag containing a packaged product therein, said product being packaged within the bag according to the method of claim 1.

18. A method of packaging a product, the method comprising:

applying at least one product security element to be present on or within a pre-formed bag, in a bag region to be sealed, the at least one product security element comprising an optically variable device (OVD);

filling the bag with the product; and subsequently forming a seal and sealing the bag using a heat sealing apparatus, the seal passing through at least a portion of the at least one product security element, thereby permanently heat sealing the product security element to the bag, wherein the seal passes through the whole of the at least one product security element.

19. The method according to claim 18, wherein the bag comprises four OVDs, and wherein the seal passes through at least a portion of at least two of said OVDs.

* * * * *